United States Patent [19]

Avril

[11] 4,383,379

[45] May 17, 1983

[54] MACHINE FOR DRYING AND MIXING GRANULAR MATERIALS

[76] Inventor: Arthur C. Avril, P.O. Box 17087, Cincinnati, Ohio 45217

[21] Appl. No.: 231,989

[22] Filed: Feb. 6, 1981

[51] Int. Cl.[3] ..... F26B 25/16; F26B 11/04

[52] U.S. Cl. ..... 34/128; 34/135; 366/235

[58] Field of Search ..... 366/25, 220, 225, 226, 366/231, 235; 432/110, 112; 34/128, 129, 135, 136, 137

[56] References Cited

U.S. PATENT DOCUMENTS

| | | | |
|---|---|---|---|
| 1,787,197 | 12/1930 | Harty et al. | 34/135 |
| 1,824,717 | 9/1931 | Harty et al. | 34/135 |
| 4,175,335 | 11/1979 | Avril | 34/128 |
| 4,262,429 | 4/1981 | Avril | 34/128 |
| 4,282,656 | 8/1981 | Schiel | 34/110 |

*Primary Examiner*—Larry I. Schwartz
*Attorney, Agent, or Firm*—James W. Pearce; Roy F. Schaeperklaus

[57] ABSTRACT

A machine for drying granular materials such as sand and gravel. The machine includes coaxial inner and outer cylinders. Moist sand is introduced into an inlet end of the inner cylinder and gravel is introduced into the inlet end of the outer cylinder. The sand is moved along the inner cylinder by impellers toward the outlet end of the inner cylinder in heat exchange relation with the inner cylinder while the sand is heated to evaporate water therefrom. The heated sand is directed from the outlet end of the inner cylinder into an inlet end portion of the outer cylinder to mix with the gravel. Impeller assemblies mounted on the interior of the outer cylinder raise the sand-gravel mixture as the cylinders rotate to cause the sand-gravel mixture to advance along the space between the cylinders toward the outlet end of the outer cylinder and to cascade against an outer wall of the inner cylinder. End portions of the inner cylinder are carried by support assemblies mounted on the outer cylinder. Resilient support assemblies support a central portion of the inner cylinder. The resilient support assemblies accommodate variations in diameter of central portions of the cylinders during operation of the machine.

4 Claims, 6 Drawing Figures

FIG. 5
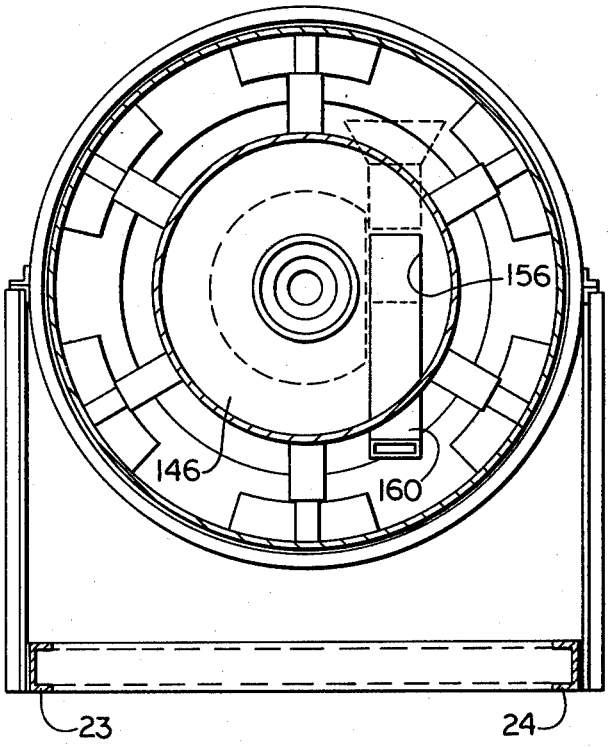
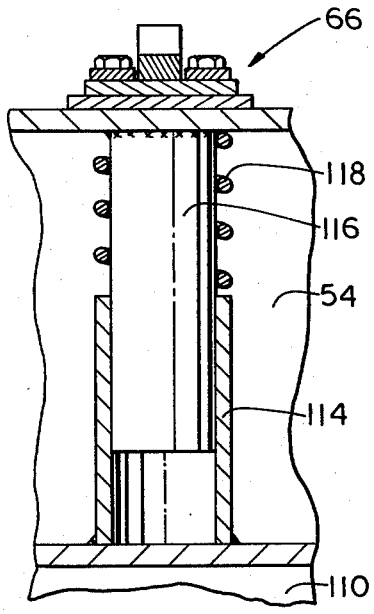
FIG. 6

MACHINE FOR DRYING AND MIXING GRANULAR MATERIALS

This invention relates to a machine for drying and mixing granular materials. More particularly, this invention relates to a machine for drying sand and gravel for use in manufacture of premixed packaged concrete and for mixing the sand and gravel.

The machine represents an improvement over the type of machine shown in my U.S. Pat. No. 4,175,335 and my application of patent, Ser. No. 06/053,335 filed June 29, 1979 now Pat. No. 4,262,429, a continuation-in-part of my application Ser. No. 652,632 filed Jan. 26, 1976, now abandoned. Such a machine can include two coaxial cylinders. Sand, which can carry entrained water, can enter one end of the inner cylinder and progress along the inner cylinder in a first direction to be discharged into the outer cylinder. Gravel can be introduced into the outer cylinder and is mixed with the sand to form a sand-gravel mixture which progresses along the outer cylinder in an opposite direction. Heating gases can be projected into the inner cylinder, and the gases heat the sand to evaporate the water therefrom.

An object of this invention is to provide an improved interconnection between the inner and outer cylinders to cause the cylinders to turn together and maintain the inner cylinder in position inside the outer cylinder while accomodating changes in dimensions of the cylinders during the heating of contents of the cylinders.

A further object of this invention is to provide a resilient mounting for a portion of the inner cylinder inside the outer cylinder which accommodates expansion of the inner cylinder as the contents thereof are heated.

A further object of this invention is to provide a spring mounting for a portion of the inner cylinder which accomodates flexing of the cylinders during heating.

Briefly, this invention provides a pair of coaxial cylinders, one of which is mounted inside the other. End portions of the cylinders are connected together to support an inner cylinder inside and outer cylinder. Radially projecting tubular first telescoping members are mounted on one of the cylinders spaced from the end portions and substantially centrally thereof. The first telescoping members are in telescoping relation with radially projecting second telescoping members mounted on the other of the cylinders. Helical compression springs are mounted on the second telescoping members and bear on ends of the first telescoping members and on the other of the cylinders to resiliently support a middle portion of the inner cylinder inside the outer cylinder while permitting flexing of the middle portions of the cylinders. Sand, which can contain moisture, can be introduced into one end of the inner cylinder. Impeller members are mounted on the inside of the wall of the inner cylinder and act to advance the sand along the interior of the inner cylinder to an opposite end thereof at which the sand falls into the space between the outer and inner cylinders. Heating gases are directed along the inner cylinder. The sand discharging into the outer cylinder is substantially dry and at an elevated temperature. Gravel can be introduced into the space between the inner and outer cylinders at the opposite end to be mixed with the sand to cause averaging of the temperature between the cold gravel and the hot sand. Impeller members mounted on the interior of the outer cylinder raise and sand-gravel mixture and pour the mixture against the inner cylinder while advancing the mixture toward the end at which the sand enters. Catch plate members can be mounted on the outer wall of the inner cylinder to catch the mixture and hold the mixture against the wall of the inner cylinder so that, as the mixture starts along the space between the cylinders, the mixture absorbs surface heat from the inner cylinder reducing the temperature of the mixture by capturing waste heat. As the mixture approaches the discharge end of the outer cylinder, the temperature of the mixture is further reduced. The mixture is discharged from the space between the cylinders at the sand entry end. The outer cylinder is rotatably mounted, and means is provided for turning the outer cylinder. The telescoping members support the inner cylinder centrally thereof while accommodating variations in cylinder diameter as cylinder temperatures change.

The above and other objects and features of the invention will be apparent to those skilled in the art to which this invention pertains from the following detailed description and the drawings, in which:

FIG. 5 is a view in section taken on the line 5—5 in FIG. 1, impellers and catch plates being omitted for clarity; and FIG. 6 is a view in section taken on an enlarged scale on the line 6—6 in FIG. 2.

In the following detailed description and the drawings, like reference characters indicate like parts.

Figure 1:
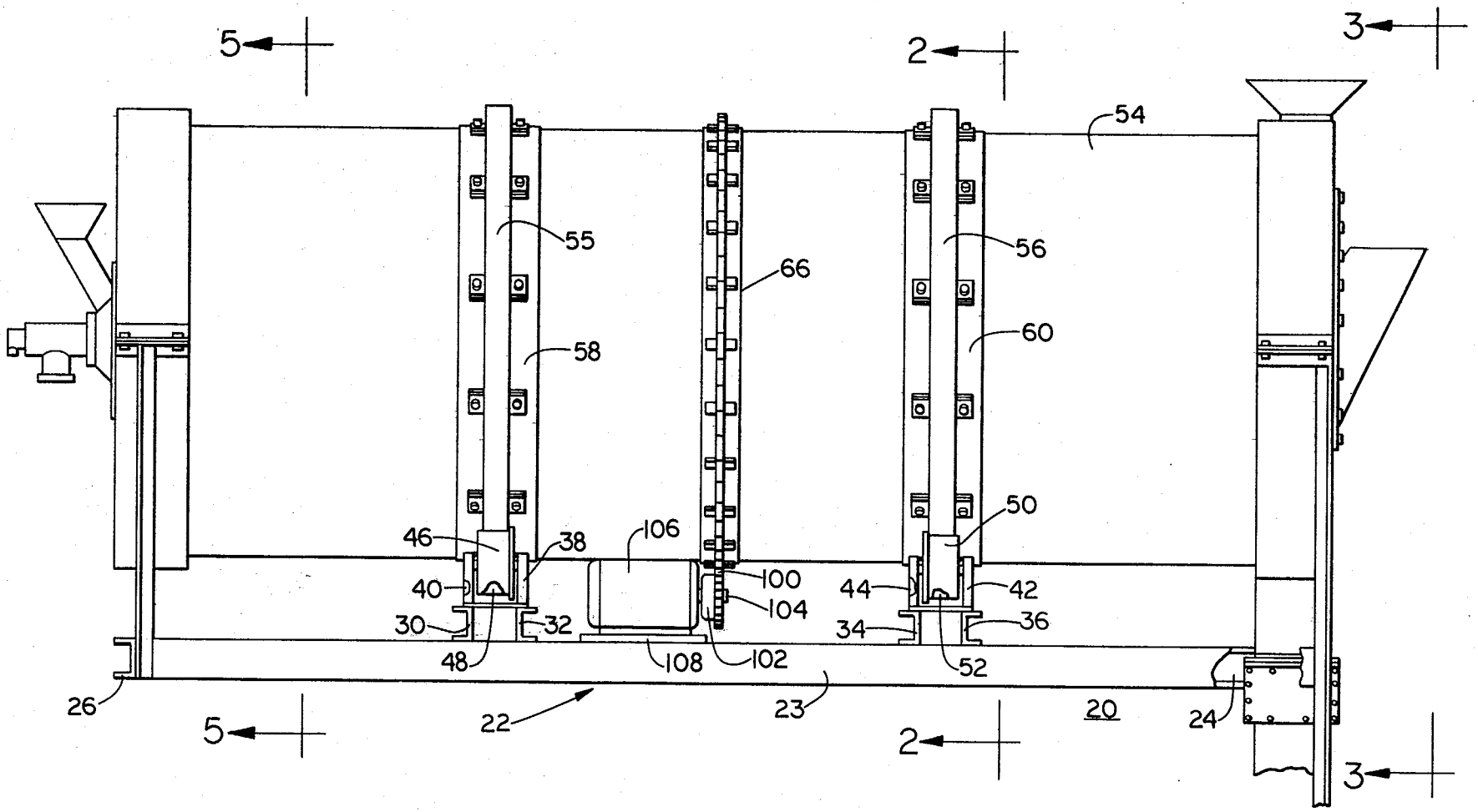
FIG. 1 is a view in side elevation of a drying and mixing machine constructed in accordance with an embodiment of this invention, a portion of a discharge chute being shown in association therewith.
Figure 3:
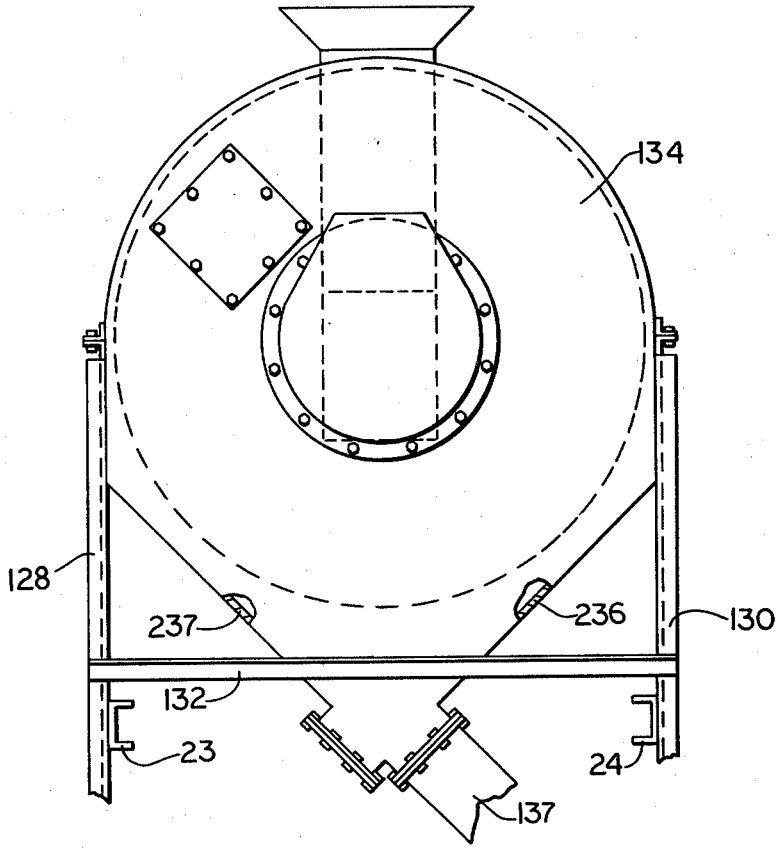
FIG. 3 is a view in end elevation looking in the direction of the arrows 3—3 in FIG. 1.

In the drawings is shown a drying machine 20 constructed in accordance with an embodiment of this invention. The machine 20 is supported on a framework 22, which includes lengthwise main frame members 23 and 24 and crosswise main frame members 26, only one of which is shown. Cross beams 30, 32, 34, and 36 span the main frame members 23 and 24 and carry roller supports 38, 40, 42 and 44. Rollers 46, 48, 50 and 52 are rotatably supported on the roller supports 38, 40, 42 and 44, respectively. The rollers 46, 48, 50 and 52 rotatably support an outer cylinder 54. Ring-shaped track members 55 and 56 are mounted on reinforcing rings 58 and 60, respectively. The reinforcing rings 58 and 60 can be attached to the outside wall of the outer cylinder 54, as by welding.

A sprocket assembly 66 is mounted on the outer cylinder 54 between the track members 55 and 56. The sprocket assembly 66 can be constructed like the sprocket assembly shown in my U.S. Pat. No. 4,175,335, to which reference is made for details of construction of the sprocket assembly 66. A drive chain 100 (FIG. 2) runs on the sprocket assembly 66 and on a sprocket 102. The sprocket 102 is carried by a drive shaft 104, which is driven by a motor 106. The motor 106 is carried on a mounting plate 108 that is, in turn, supported on the lengthwise main frame member 23.

Figure 2:
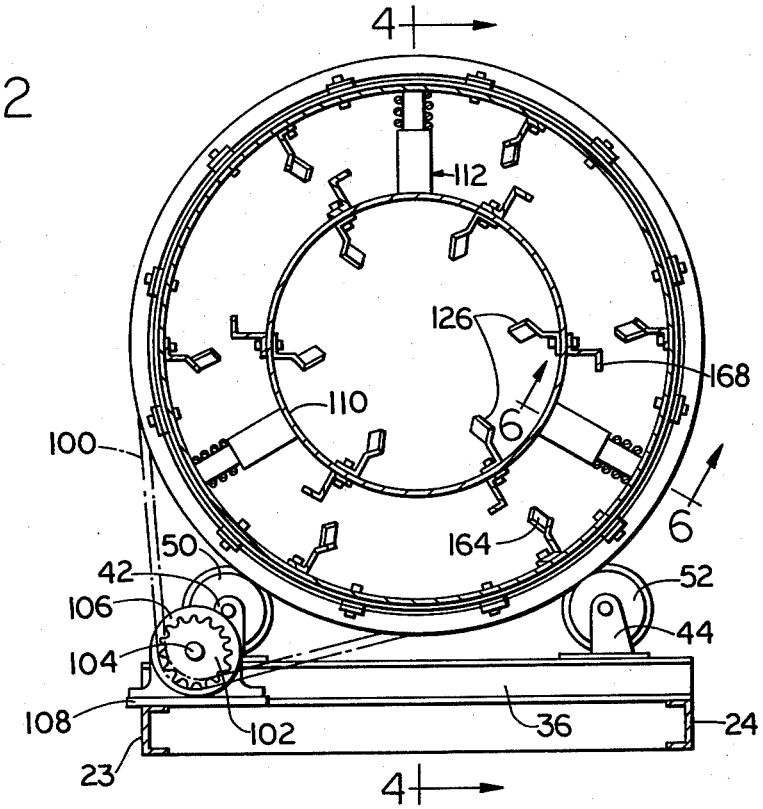
FIG. 2 is a view in section taken on the line 2—2 in FIG. 1.
Figure 4:
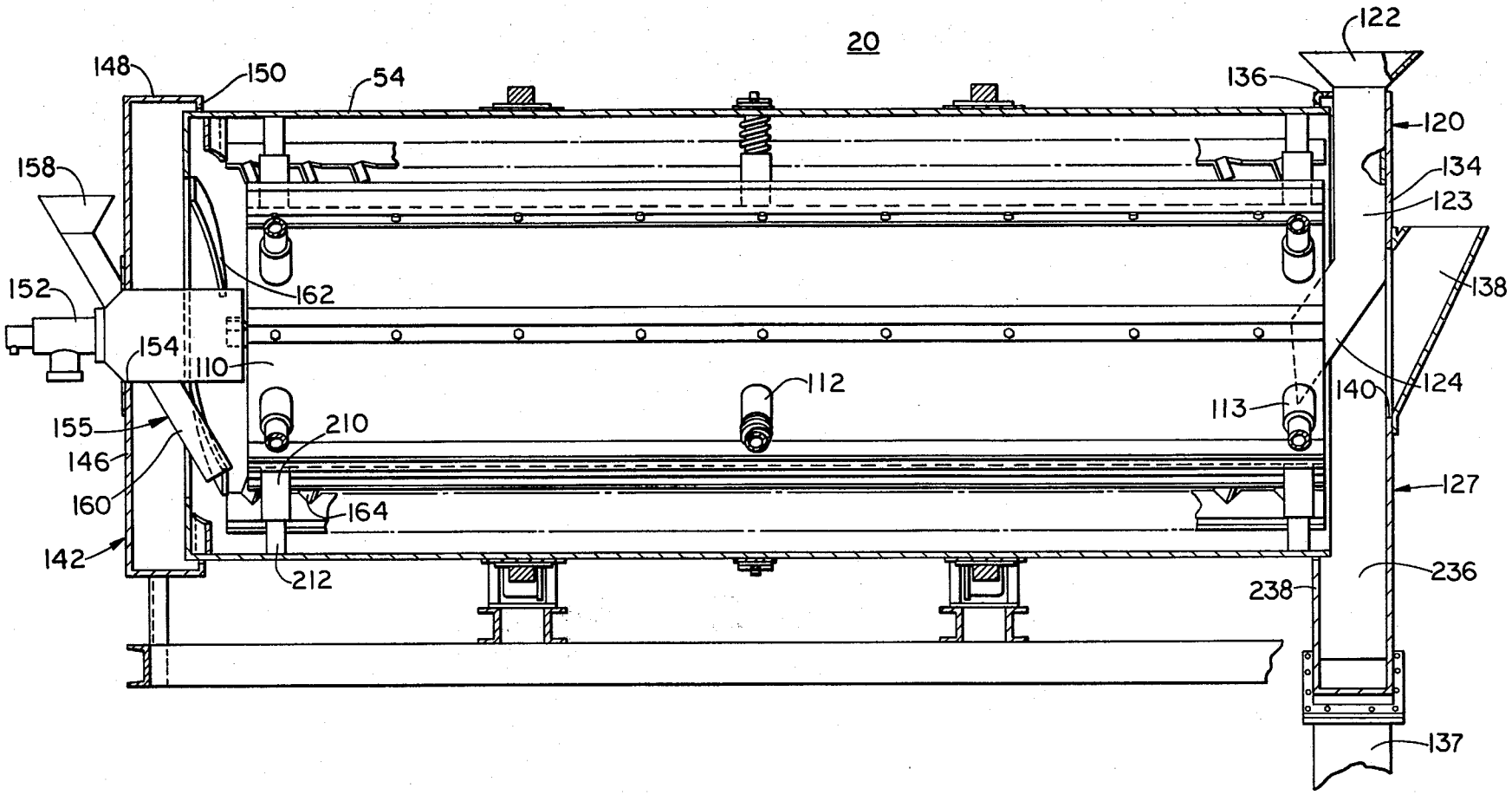
FIG. 4 is a view in section taken generally on the line 4—4 in FIG. 2.

A hollow inner cylinder 110 is mounted inside the outer cylinder 54 in coaxial relation therewith, as shown in FIGS. 2 and 4, and is supported by a plurality of main support assemblies 113. Six support assemblies are located and spaced angularly adjacent each end of the inner cylinder 110, and each support assembly reaches from the inner cylinder 110 to the outer cylinder 54. Three resilient support assemblies 112 are spaced angularly adjacent the center of the machine as shown in FIGS. 2 and 4. Each of the resilient support assemblies 112, as shown in FIG. 6, includes a radially projecting tubular first telescoping member 114, which is welded to the outer wall of the inner cylinder 110, and a radially projecting second telescoping member 116 welded on the inner wall of the outer cylinder 54. A compression spring 118 is mounted on the second telescoping member 116 and bears on the wall of the outer cylinder 54 and on an end of the first telescoping member 114 to resiliently support the inner cylinder 110 inside the outer cylinder 54.

Each of the main support assemblies 113 includes an outer tubular member 210 (FIG. 4) mounted on the exterior of the inner cylinder 110 and an inner member 212 mounted on the interior of the outer cylinder 54. During manufacture of the apparatus, the inner and outer cylinders are assembled with the members of the main support assemblies in telescoping relation. The inner cylinder 110 is centered in the outer cylinder 54, and the outer tubular member 210 of each main support assembly is welded to the inner member 212 thereof so that the end portions of the inner cylinder 110 are rigidly held in centered relation inside end portions of the outer cylinder.

Sand is introduced into the right hand end of the inner cylinder 110 through a hollow chute 120. The chute 120 includes a funnel portion 122, into which the sand is introduced, a hollow vertical portion 123, and a sloping portion 124, which discharges the sand into the interior of the inner cylinder 110. The sand can contain water, which is removed in the drying and mixing machine. The sand is advanced along the inner cylinder 110 by impeller assemblies 126. The impeller assemblies 126 can be constructed like impeller assemblies shown in my U.S. Pat. No. 4,175,335, and the impeller assemblies 126 advance the sand along the inner cylinder 110 while causing the sand to cascade across the inner cylinder.

The chute 120 is mounted inside an end housing 127. The end housing 127 is supported on upright angle members 128 and 130 carried by the lengthwise main frame members 23 and 24, respectively. A cross bar 132 links and upright angle members 128 and 130. The end housing 127 includes a plate portion 134, which overlies the right hand end of the main cylinder 54 as shown in FIG. 4. The end housing 127 also includes a half cylindrical flange 136, which overlies the upper portion of the right hand edge of the main cylinder 54, sloping catch plates 236 and 237, which underlie the right hand edge of the main cylinder 54, and a vertical flange portion 238, which terminates in closely spaced relation to the outer wall of the main cylinder 54. A discharge chute 137 carried by the end housing 127 receives particulate material discharged from the right hand end of the main cylinder 54. A vent stack 138 mounted on the plate 134 and communicating with a central opening 140 in the plate 134 permits discharge of products of combustion from the inner cylinder 110.

At the left hand end of the main cylinder 54 is mounted a heater housing 142. The heater housing 142 includes a plate portion 146, which overlies the left hand end of the main cylinder 54, a ring portion 148, which overlies the left hand edge of the main cylinder 54, and an inwardly directed flange 150. The inner edge of the flange 150 is spaced from the outer wall of the main cylinder 54 to permit entry of ambient air. A burner 152 is mounted in a central opening 154 of the plate portion 146 and can project hot combustion gases into the interior of the inner cylinder 110. The burner 152 can burn natural gas or any flammable volatile liquid or gas. The burner 152 can project a flame into the central portion of the inner cylinder 110 so that the portion of the inner cylinder 110 surrounding the resilient support assemblies 112 can be the hottest portion thereof.

A gravel chute 155 is mounted on and extends through an opening 156 in the plate portion 146. The gravel chute 154 includes a funnel portion 158, into which the gravel is introduced, and a tubular portion 160, which discharges into the interior of the main cylinder 54. Helical vanes 162 mounted on the interior of the main cylinder 54 advance the gravel to impeller assemblies 164.

The impeller assemblies 126 in the inner cylinder 110 serve to advance sand to the left as shown in FIG. 4 along the inner cylinder 110 as the cylinders 54 and 110 rotate while causing the sand to cascade across the inner cylinder 110 as the products of combustion from the burner 152 pass along the interior of the inner cylinder 110 to heat and dry the sand as the sand moves along the inner cylinder toward the left hand end thereof. When the sand reaches the left hand end of the inner cylinder 110, the heated and dried sand falls into the main cylinder 54 where the sand is mixed with the gravel that enters through the gravel chute 155 to form a sand-gravel mixture. The sand-gravel mixture is propelled to the right and caused to cascade across the space between the inner cylinder 110 and the main cylinder 54 by the impellers 164 and, as the sand-gravel mixture cascades against the inner cylinder 110, catch plate assemblies 168 (FIG. 2) catch and hold the sand-gravel mixture against the outer face of the inner cylinder 110 so that the sand-gravel mixture is cooled as it advances along the space between the inner cylinder 110 and the outer cylinder 54. An appropriate exhaust fan (not shown) can be connected to the vent stack 138 for drawing air through the space between the inner and outer cylinders to aid in cooling the sand-gravel mixture. The fan can divert the air and stack gases to appropriate pullution control devices (not shown).

The impeller assemblies can be of the type shown in my U.S. Pat. Nos. 3,514,870 and 4,175,335.

The catch plate assemblies 168 can be of the type shown in my U.S. Pat. No. 4,175,335 to which reference is made for details of construction.

As the sand-gravel mixture approaches the discharge chute 137, the wet sand on the interior of the inner cylinder 110 serves to cool the wall of the inner cylinder and to cool the sand-gravel mixture before it is discharged.

The sand enters the machine at its storage temperature and is heated to a sufficient termperature, such as 270–300° F., to cause evaporation of water carried by the sand and so that, when the sand is mixed with the gravel, any water carried by the gravel is also evaporated. The burner can be mounted at either end of the inner cylinder, but preferably is mounted, as shown, at the end where the sand leaves the inner cylinder. The sand-gravel mixtures can leave the machine barely warm, as at a temperature of 120–140° F. The cylinders, impeller assemblies and catch plate assemblies can be formed of steel or the like. The sand-gravel mixture leaving the machine can be used as it leaves the machine, or the mixture can be separated into different sizes to be recombined as required.

As the apparatus operates, heating of the portion of the inner cylinder 110 near the resilient support assemblies can cause distortion of the inner cylinder particularly in this portion thereof, and flexing of the springs 118 accommodates variations in diameter of the central portions of the cylinders during operation.

The drying and mixing apparatus illustrated in the drawings and described above is subject to structural modification without departing from the spirit and scope of the appended claims.

Having described my invention, what I claim as new and desire to secure by letters patent is:

1. An apparatus for drying a first and second material comprising:

a first rotatable cylinder having first and second ends;

a second cylinder, said second cylinder having third and fourth ends, said third and fourth ends being respectively adjacent said first and second ends;

main support assembly means mounted on said second cylinder at end portions of the second cylinder and supported in said first cylinder for supporting said second cylinder within and substantially coaxially with said first cylinder;

a means for rotating said cylinders, the means for rotating said cylinders comprising a sprocket ring on said first cylinder, a motor, said motor having an output shaft, a sprocket gear on said output shaft, and a chain engaging with said sprocket ring and said sprocket gear;

a means for introducing a moist first material into said third end of said second cylinder;

a means for heating said moist first material;

a means for moving said first material through said second cylinder and out said fourth end of said second cylinder and into said second end of said first cylinder in a continuous stream and for lifting said first material such that said first material falls onto the interior surface of said second cylinder, said means for moving said first material through said second cylinder comprising a plurality of impellers spaced radially about the interior of said second cylinder and extending longitudinally thereof;

a means for introducing a moist second material into said second end of said first cylinder;

means for moving said first and second materials through said first cylinder in a direction opposite to the flow of said first material in said second cylinder and for lifting said first and second material such that said first and second materials fall downwardly whereby said first and second materials are dried in a continuous operation, said means for moving said first and second materials through said first cylinder comprising a plurality of impellers spaced radially about the interior of said first cylinder and extending longitudinally thereof, a plurality of resilient support assemblies spaced radially about the interior of said first cylinder spaced between the end portions of the second cylinder, each of said support assemblies being housed inside the first cylinder and including a first telescoping member attached to the interior of the first cylinder, the first cylinder being imperforate at the support assemblies, a second telescoping member attached to the exterior of the second cylinder and spring means urging the telescoping members toward extended position, thereby allowing said second cylinder to expand and contract spaced from the end portions thereof.

2. An apparatus as in claim 1 in which each of the resilient support assemblies includes an inner telescoping member, an outer telescoping member, and a helical compression spring mounted on the inner telescoping member and bearing on an end of the outer telescoping member to urge the telescoping members to extended position.

3. An apparatus for drying fine and coarse aggregate comprising:

an outer rotatable cylinder having first and second ends;

an inner cylinder, said inner cylinder being shorter in length than said outer cylinder, main support assembly means at end portions of the inner cylinder and supported on the interior of the outer cylinder for mounting the inner cylinder within and substantially coaxial with said outer cylinder, said inner cylinder further having third and fourth ends, said third and fourth ends being respectively adjacent said first and second ends;

a plurality of resilient support assemblies spaced radially about the interior of said outer cylinder and spaced between the end portions of the inner cylinder, each of said resilient support assemblies including a first telescoping member attached to the interior of the outer cylinder, a second telescoping member attached to the exterior of the inner cylinder, and spring means urging the telescoping members toward extended position, each of the support assemblies being housed inside the outer cylinder, the outer cylinder being imperforate at the support assemblies;

a means for rotatably supporting said outer cylinder;

a means for rotating said outer cylinder;

a means for introducing moist fine aggregate into said third end of said inner cylinder;

a source of heat for heating said moist fine aggregate and said inner cylinder;

a means for moving said fine aggregate through said inner cylinder and out said fourth end of said inner cylinder and into said second end of said outer cylinder in a continuous stream and for lifting said fine aggregate such that said fine aggregate falls onto the interior of said inner cylinder;

a means for introducing moist coarse aggregate into said second end of said outer cylinder; and means for moving said fine and coarse aggregate through said outer cylinder in a direction opposite to the flow of said fine aggregate in said inner cylinder and for lifting said fine and coarse aggregate such that said fine and coarse aggregate fall downwardly, whereby said fine and coarse aggregate absorb heat from said inner cylinder and are thereby dried in a continuous operation, said spring means allowing the portion of the inner cylinder between end portions thereof to expand and contract.

4. An apparatus as in claim 3 in which the second telescoping member is tubular, the first telescoping member is slidably mounted inside the second telescoping member, and the spring means is a compression spring mounted on the first telescoping member and bearing on an end of the second telescoping member and on the interior of the outer cylinder.

* * * * *